United States Patent [19]

Kronenberger et al.

[11] 4,013,434

[45] Mar. 22, 1977

[54] HYDRATOR DRAWER COVER WITH ADJUSTABLE MOISTURE CONTROL DAMPER

[75] Inventors: Paul E. Kronenberger; Robert Smith, both of Dayton, Ohio

[73] Assignee: General Motors Corporation, Detroit, Mich.

[22] Filed: Apr. 5, 1976

[21] Appl. No.: 673,634

[52] U.S. Cl. ..... 62/382; 62/408

[51] Int. Cl.[2] ..... F25D 17/04

[58] Field of Search ..... 62/382, 407, 408

[56] References Cited

UNITED STATES PATENTS

| | | | |
|---|---|---|---|
| 2,114,882 | 4/1938 | Knight | 62/382 |
| 2,177,540 | 10/1939 | Steenstrup | 62/382 |
| 2,219,833 | 10/1940 | Atchison | 62/382 |
| 2,281,690 | 5/1942 | Hedlund | 62/382 |
| 3,364,694 | 1/1968 | Cohen et al. | 62/382 |
| 3,600,905 | 8/1971 | Dymek et al. | 62/382 |

*Primary Examiner*—Lloyd L. King
*Attorney, Agent, or Firm*—Edward P. Barthel

[57] ABSTRACT

An airflow moisture control for use with a refrigerator food storage hydrator drawer cover and guide that enables the user to vary the amount of moisture therein by adjustable side vents. The manual control includes a damper and integral hinge pin with cooperating flexible arcuate fingers extending through the vents having surfaces thereon for engaging the edge portions of their associated vents so as to impart positioned stability for selectively rotating the damper in any one of a plurality of angularly related positions. The dampers are interchangeable for hingedly engaging the cover for either left or right side operation.

4 Claims, 10 Drawing Figures

HYDRATOR DRAWER COVER WITH ADJUSTABLE MOISTURE CONTROL DAMPER

This invention relates to domestic refrigerators and more particularly to airflow control means for food storage hydrators.

Hydrators in the form of vegetable drawers have long been incorporated in the above-freezing food storage chamber of refrigerators. These drawers are utilized for the storage of unwrapped food such as leafy vegetables which contain a high percentage of water and require high humidity storage to retain their fresh, crisp appearance. While the storage of fresh vegetables and the like in a household refrigerator cabinet is somewhat temporary, since they are usually used within a week or 10 days, it is nevertheless important that these vegetables be properly preserved during this time in order to retain their freshness. In the case of the storage of vegetables some moisture may collect in the hydrators, because of the high moisture content of the vegetables, and seasonal changes in humidity conditions. A need has arisen therefore for means to control the moisture content of the hydrator drawer or receptacle.

It is therefore an object of the present invention to provide an improved airflow control damper for a food storage receptacle for the refrigerated compartment of a refrigerator with means for facilitating smooth movement while imparting positioned stability so that the damper can be retained in any one of a plurality of positions.

It is another object of the present invention to provide an improved airflow control damper for hingedly engaging a cover for a pair of hydrator drawers which is interchangeable for operation on either the left or right side of the cover.

Another object of the present invention is to provide an improved manual moisture control venting structure for a hydrator drawer cover with vent openings located above the drawer guides wherein an integrally molded elongated damper blade and hinge pin is provided with a plurality of flexible arcuate fingers which slidably engage the vent openings and wherein, by means of hinge brackets imparting a longitudinal bow to the damper, frictionally biases the edges of the vents and the flexible fingers for selectively positioning the damper in any one of a plurality of positions depending upon the need as posed by humidity and temperature conditions without and within the refrigerator.

Further objects and advantages of the present invention will be apparent from the following description, reference being had to the accompanying drawings wherein a preferred embodiment of the present invention is clearly shown.

Figure 1:
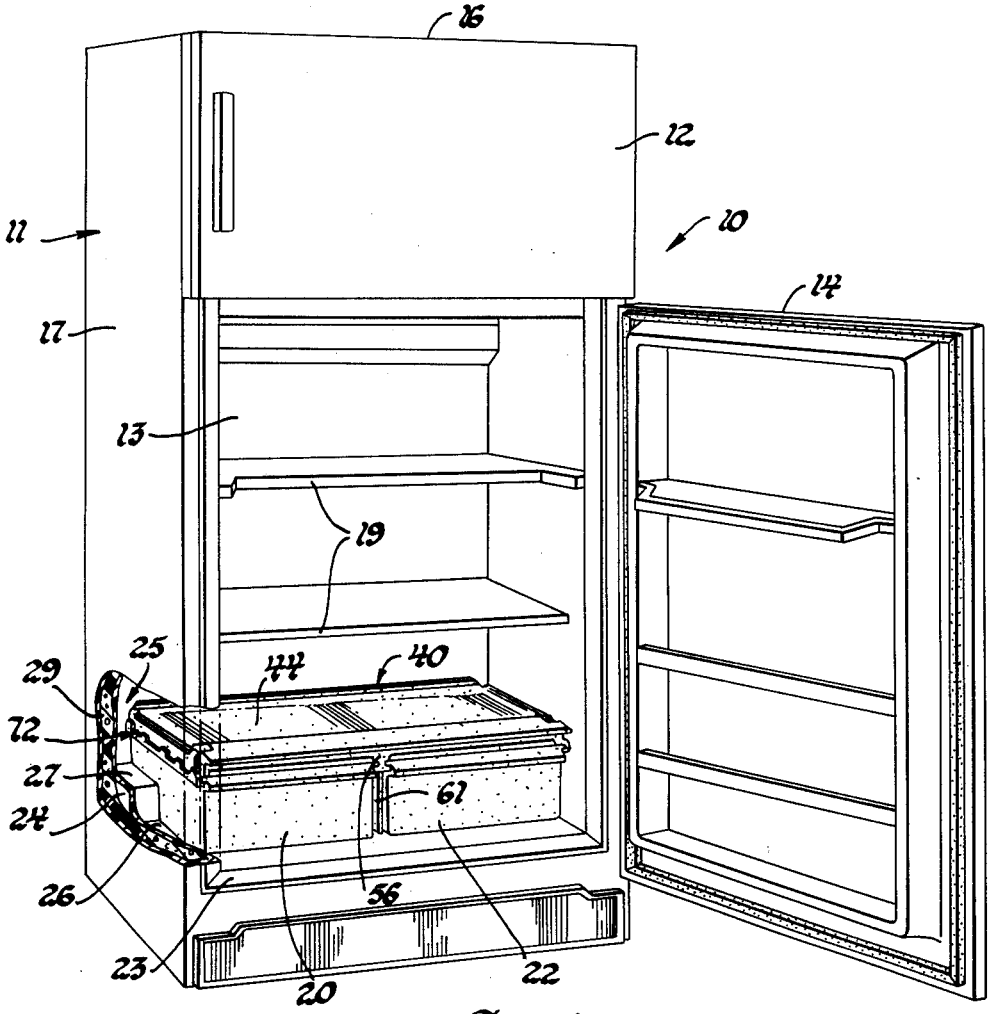
FIG. 1 is a perspective view of a household refrigerator cabinet with the access door to a food storage chamber thereof in open position and part of the cabinet broken away, showing the invention incorporated therein.

Referring now to the drawings, there is shown in FIG. 1 a refrigerator 10 including an outer cabinet shell 11 having an upper freezer compartment (not shown) enclosed by an upper insulated access door 12 and a lower fresh food compartment 13 closed by a lower insulated access door 14, shown in its open position. The cabinet 11 includes an insulated top outer wall 16, insulated side walls 17 and 18, the inner surface of which extend rearwardly from the cabinet front opening, and having disposed therebetween in the lower compartment a plurality of shelves 19 and lower storage receptacles in the form of vegetable hydrator drawers or crisper pans 20 and 22 above compartment insulated bottom wall 23. The drawers 20 and 22 are preferably integrally molded of plastic material such as high impact polystyrene or ABS copolymer.

A conventional cooling unit (not shown) is located in the machinery compartment 24 of the refrigerator in the manner shown in U.S. Pat. No. 3,696,632, R. E. Carlin et al, assigned to the same assignee as the present application. Within the outer shell is a one-piece inner plastic liner 25 having a bottom wall provided with a front lower section 26 and a rear higher section 27 over the motor-compressor and condenser of the refrigerating unit located in the machinery compartment 24 below. The inner liner 25 and outer shell 11 include spaced walls with suitable insulation such as plastic foam insulation 29 containing an insulating gas cast between the inner liner and outer shell which reinforces both the liner and shell.

Figure 3:
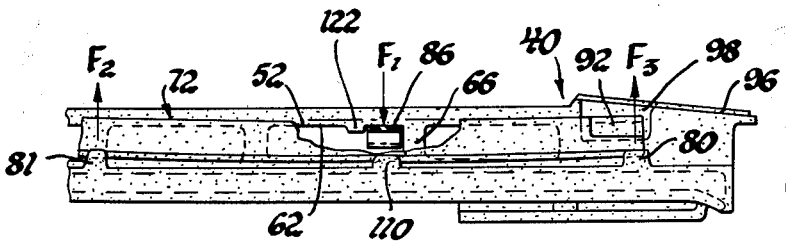
FIG. 3 is a fragmentary view of the front portion of FIG. 2 showing the resultant forces acting on a portion of the control damper.
Figure 5:
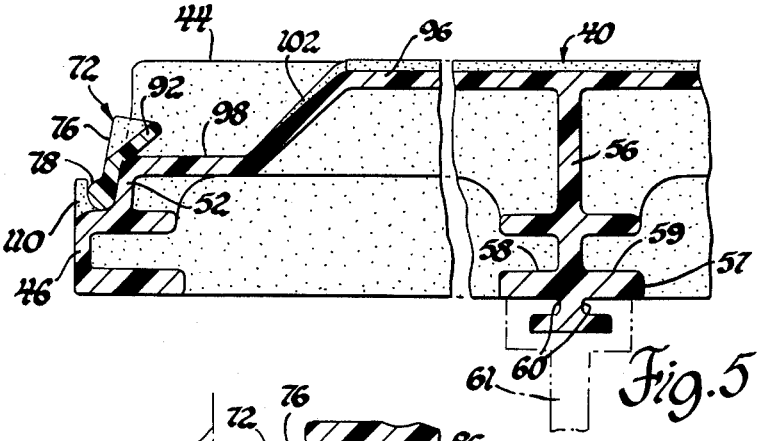
FIG. 5 is an enlarged fragmentary vertical sectional view taken on the line 5—5 of FIG. 4.
Figure 6:
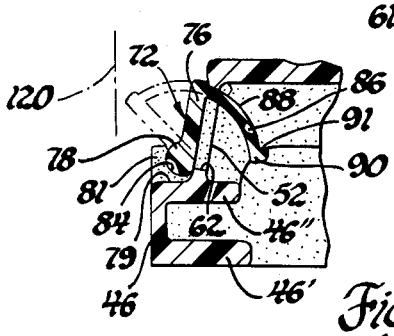
FIG. 6 is an enlarged fragmentary sectional view taken along the line 6—6 of FIG. 4.
Figure 7:
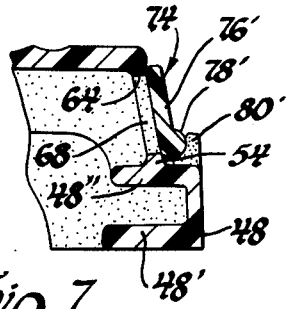
FIG. 7 is an enlarged fragmentary sectional view taken substantially along the line 7—7 of FIG. 4.
Figure 8:
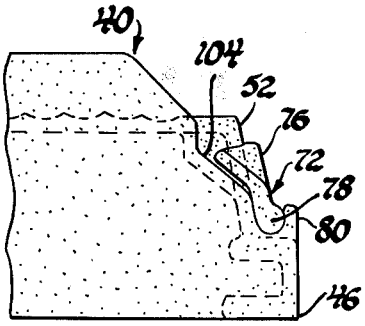
FIG. 8 is an enlarged fragmentary elevational view taken along the line 8—8 of FIG. 4.

As shown in FIG. 1, a hydrator drawer cover and guide member, generally indicated at 40, is supported in spaced relation above the liner bottom sections 26 and 27 of the refrigerator food compartment by suitable means, such as by supporting pegs or studs shown at 42 in FIG. 3 and described in detail in U.S. Pat. No. 3,649,059, J. W. Davidson, assigned to the assignee of the present invention. The receptacle hydrator cover and guide member 40, preferably molded of suitable plastic material such as impact polystyrene, includes a horizontally disposed cover plate and shelf 44 which overlies the hydrator drawers 20 and 22. As seen in FIGS. 5 and 6, a pair of depending integral U-sectioned members are molded along both sides of plate 44 to provide opposed left and right hand outer trackways or guideways 46 and 48, respectively, formed by parallel upper and lower flanges 46' and 46'' for guideway 46 and flanges 48' and 48'' for guideway 48. The outer guideways 46 and 48 are positioned a defined distance below the plane of the cover plate 44 by means of integral side edge strips 52 and 54. The plate 44 also has an integral longitudinally extending center partition 56 supporting an elongated support beam 57 that is substantially rectangular in cross-section and has oppositely facing left-hand inner guideway 58 and a right-hand guideway 59 which cooperate with their associated opposed outer guideways 46 and 48 for slidably receiving and supporting the hydrator drawers 20 and 22, respectively. A lower set of grooves 60 are provided on beam 57 for receiving a support panel shown at 61 in FIG. 1.

Figure 2:
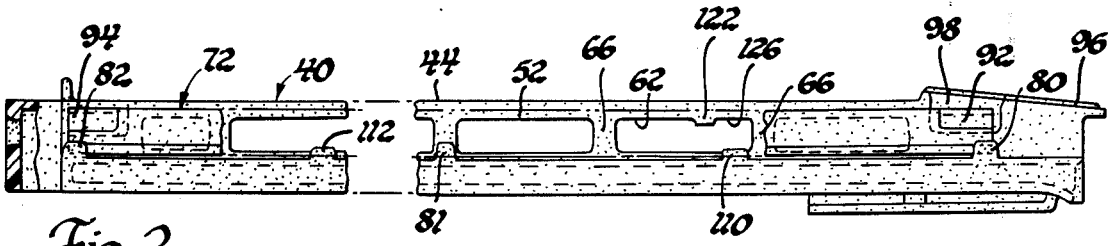
FIG. 2 is a side elevational view of the hydrator and left control damper with parts broken away.

Each of the side edge strips 52 and 54 includes a plurality or series of ventilating apertures or openings, as shown in FIGS. 2 and 3 by openings 62 in strip 52 and openings 64 in strip 54. The openings 62 and 64 in the form disclosed have an elongated rectangular outline separated by intermediate post-like dividers 66 and 68. The openings 62 and 64 are designed to allow the exit of moisture laden air from their respective drawers 20 and 22 to flow outwardly therefrom into the fresh food compartment to decrease the amount or level of moisture within the drawers.

To enable the housewife to control the humidity condition within each of the drawers each series of openings 62 and 64 in left and right side strips are provided with a one-piece valve-like closure baffle or control damper, generally indicated at 72 for the left-hand openings 62 and damper blade 74 for the right-hand openings 64. As best seen in FIG. 1, the control dampers 72 and 74 are identical in structure such that they can be used interchangeably for either right or left side operation. This is an important feature of the invention as it is necessary for the supplier to only stock a single damper part which may be attached to the cover plate 40 selectively for throttling either the right edge openings 62 or the left edge openings 64 by merely being turned end-for-end thus allowing for ready replacement by the customer for purposes of cleaning or the like.

As the damper members 72 and 74 are identical only the left hand damper 72 will be described in detail with primed reference numerals being used to indicate the corresponding parts of damper 74. The damper 72 is preferably an integral member molded from plastic material such as impact polystyrene providing an elongated vane or blade 76 with one edge formed with an integral hinge pin 78 adapted to pivot within hinge brackets 80, 81 and 82 integrally molded on the upper surface 79 of left trackway 46. Each of the left hinge brackets 80, 81 and 82 and corresponding right hinge brackets 80′, 81′ and 82′ on right-hand trackway 48 have upwardly opening radiused slots 84 for the reception of the damper hinge pin 78.

The damper 72 further includes a plurality of flexible arcuate fingers molded integrally therewith positioned along the free edge of blade 76 in longitudinal spaced relation. In the form shown damper member 72 has two fingers 86 and 87 which in their assembled relation are located with finger 86 approximately midway between the front hinge bracket 80 and middle hinge bracket 81 while finger 87 is approximately midway between the middle bracket 81 and rear bracket 82. Thus, as seen in FIG. 4 when assembled the front finger 86 extends through the second left-hand opening 64 from the front while the finger 87 extends through the sixth opening.

Each finger has an arcuate upper surface 88 radiused for engaging the adjacent top edge portion of its associated opening 64. As seen in FIG. 6, the fingers 86 and 87 include a raised lip portion 90 molded on the free end thereof providing a radially disposed stop surface 91 operative to engage the inner face of side strip 52 limiting the outward pivotal movement of the dampers 72, 74 to a maximum or fully open position as shown in dotted lines in FIG. 6 wherein the damper blade 76 is positioned at an outwardly inclined angle of about 45° from the vertical.

Figure 9:
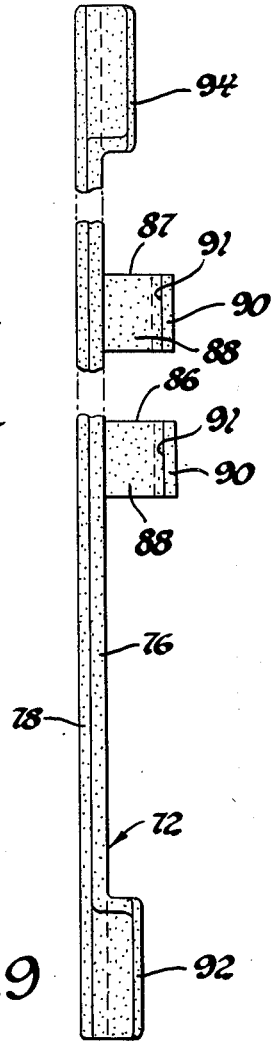
FIG. 9 is an enlarged elevational view of the damper control.

As best seen in FIGS. 5 and 9 the damper 72 is provided with manual control tabs 92 and 94 formed integrally at an inwardly canted angle from the plane of blade 76 at each end of the baffle 72. Depending upon the orientation of the baffle either the tab 92 or 94 may be used for selectively positioning the damper in any one of a plurality of angular positions from a fully closed position shown in solid lines in FIG. 6 to a maximum open position shown in dashed lines. The forward portion of the cover plate side strips 52 and 54 and the threshold portion 96 are formed or molded with left and right recessed portions generally indicated at 98 and 99 respectively to allow for the reception of the canted tabs 92 and 94, respectively. It will be noted in FIG. 5 that the recessed portion 98 is generally box-shaped with inner wall 102 sloped inwardly and upwardly to provide for ease of access of the user's thumb to push outwardly on tab 92 to rotate the damper outwardly about the axis of rod 78 to any one of a plurality of angularly related open positions.

Figure 4:
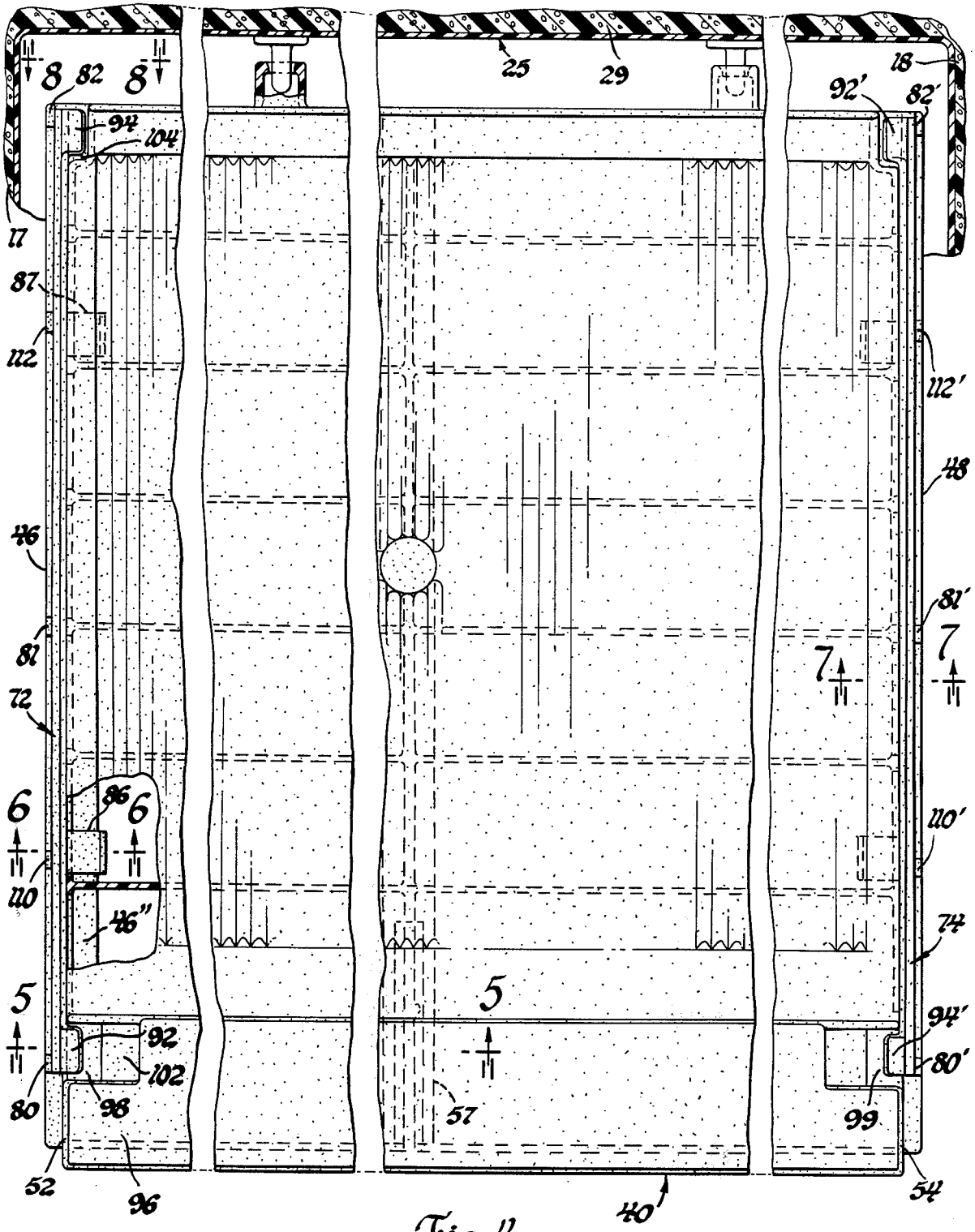
FIG. 4 is an enlarged fragmentary horizontal sectional view of the refrigerator cabinet and hydrator cover.

As seen in FIG. 4 for the left damper 92 it will be seen that the opposite or rear tab 94 is received in an integrally molded notched-out portion 104 formed at the rearward end of side strip 52 allowing the damper blade to lie flush against the strip 52 and close the openings 64. In a similar manner a notched-out portion is molded in side strip 54 to allow for the reception of tab 92′ when the damper blade 74 is in its closed position.

With reference to FIGS. 5 and 6, it will be noted that the hinge brackets 80, 81 and 82 have their grooves 84 formed to support the damper hinge pin 78 a predetermined height above the plane of the upper surface 79 of the left trackway 46. Further, the trackway upper surface 79 has formed thereon intermediate retainers 110 and 112 flush with the outer near vertical surface 96 of the left guideways 46 with the retainers 110 and 112 forming an upwardly opening slot 114 the bottom of which is coplanar with the surfaces 79. By virtue of this arrangement it will be seen in FIG. 3 that the hinge brackets 80 and 81 and the intermediate finger 86 operate to bow the damper blade and integral hinge pin 28 in a downwardly bowed curved arc, thereby biasing the upper surface 88 of finger 86 into frictional engagement with the upper edges of the openings 62. When the damper is fully closed the stress acting on the damper causes a downward force $F_1$ to be applied by the upper edge of opening 62 in the upper surface 88 of the tongue 86 opposed by equal and opposite upwardly acting forces $F_2$ and $F_3$ applied by the radiused portions 84 of the hinge brackets 81 and 80. In this way the force $F_1$ on finger 86 serves to frictionally retain the damper in its closed position. As the damper is rotated outwardly to a selected partially open position the force-balance arrangement is sufficient to impart positioned stability so that the damper can be retained in any desired position.

It will be noted that the closer the damper is to its fully closed position the less flexible the finger 86 becomes causing more bow to be imparted to the damper thus increasing the force $F_1$ and consequent frictional force insuring the retention of the damper in its closed position. Conversely, the closer the damper is rotated to its fully open position the more flexible the finger 86 becomes reducing the bow imparted to the damper. It will be seen that before the damper contacts the refrigerator liner side wall, indicated by construction line 120 in FIG. 6, the finger stop surface 96 prevents further outward rotation of the damper.

Figure 10:
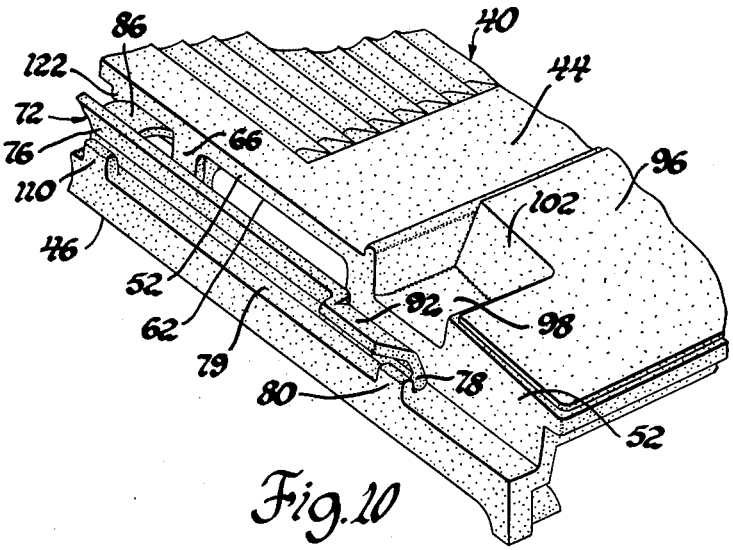
FIG. 10 is an enlarged fragmentary perspective view of a portion of the hydrator cover and damper with the damper shown in a partially open position.

With reference to FIGS. 2, 3 and 10, it will be seen that damper locaters such as lefthand lug 122 are integrally molded to depend from the upper edge of the openings 62 and 64 respectively. The locater lug 122 is dimensioned to provide a notch 126 with adjacent post 66 dimensioned to receive finger 86 and lock the damper 72 in place by preventing any longitudinal movement thereof. To remove the damper requires only the flexing of the fingers 86 and 87 from their openings after which the damper may be readily removed from the cover plate.

It will be appreciated that by virtue of applicants' baffles 72 or 74 being identical they are interchangeable by simply being reversed or turned end-for-end. This feature is achieved by providing the front and rear recessed portions 98 and 99 to allow for the reception of the canted gripping tab portions 92 and 94 upon the baffle being rotated to its fully closed position.

While the embodiment of the present invention as herein disclosed constitutes a preferred form, it is to be understood that other forms might be adopted.

We claim:

1. In a refrigerator cabinet having a food storage chamber furnished with a front access opening normally closed by a door, a refrigerating system associated with said cabinet including a refrigerant evaporator for chilling the interior thereof; a food storage closed receptacle in said chamber having an air vent for receiving refrigerated air from said chamber, a one piece baffle for adjusting the quantity of refrigerated air flowing through said vent, said receptacle having baffle engagement portions in the form of a plurality of spaced concave-like bearing surfaces opening outwardly therefrom, one edge of said baffle formed with a convex hinge surface adapted to pivot within the bearing surfaces, said baffle including a flexible arcuate finger formed integrally therewith, said finger located adjacent the opposite edge of said baffle and extending through said vent, said finger having an arcuate surface for engaging the adjacent edge portion of said vent, said finger spaced intermediate adjacent pairs of the concave-like bearing surfaces, baffle retaining means on said receptacle at said finger location causing elastic longitudinal arching of the flexible baffle between its bearing portions, which arching acts to frictionally hold said finger arcuate surface in a given relative position with said vent edge, and said finger including stop means for engagement with a stop surface carried by said receptacle, whereby said baffle may be rotated by the user from a fully closed to a fully open setting while imparting positioned stability so that the user may retain said baffle at any desired intermediate setting between its open and closed positions.

2. In a refrigerator cabinet having a food storage chamber furnished with a front access opening normally closed by a door, a refrigerating system associated with said cabinet including a refrigerant evaporator for chilling the interior thereof; a food storage closed receptacle in said chamber, a series of air vents in said receptacle for receiving refrigerated air from said chamber, a one piece baffle for adjusting the quantity of circulated air between the fresh food compartment and the receptacle, said receptacle having baffle engagement portions in the form of a plurality of spaced concave-like bearing surfaces opening upwardly therefrom, one edge of said baffle formed with a convex hinge surface adapted to pivot within the bearing surfaces, said baffle including a plurality of flexible arcuate fingers formed integrally therewith in longitudinal spaced relation, each of the fingers located adjacent the opposite edge of said baffle and extending through an adjacent vent, each finger having an arcuate surface for engaging the adjacent edge portion of its associated vent, each of the fingers spaced intermediate adjacent pairs of the cover concave-like bearing surfaces, baffle retaining means on said receptacle at each finger location causing elastic longitudinal arching of the flexible baffle between its bearing portions, which arching acts to frictionally hold each finger arcuate surface in a given relative position with its respective vent edge, each of the fingers including stop means for engagement with a stop surface carried by said receptacle, whereby said vent means structure constructed and arranged such that said baffle may be rotated by the user from a fully closed to a fully open setting while imparting positioned stability so that the user may retain said baffle at any desired intermediate setting between its open and closed positions.

3. In combination with a refrigerator cabinet having a food storage chamber furnished with a front access opening normally closed by a door, a refrigerating system associated with said cabinet including a refrigerant evaporator for chilling the interior thereof; a food storage assembly including a drawer and a supporting cover plate member therefor, said cover plate including integral flange means depending from each side thereof providing confronting longitudinal extending drawer trackways, means on said drawer in slidable engagement with said trackways, wherein the improvement for the food storage assembly comprising moisture control vent means therefor, said vent means including a series of air vents provided in one said flange means, a one piece baffle for adjusting the quantity of circulated air between the fresh food compartment and the drawer, said cover plate having baffle engagement portions in the form of a plurality of spaced concave-like bearing surfaces opening upwardly therefrom, one edge of said baffle formed with a convex hinge surface adapted to pivot within the cover bearing surfaces, said baffle including a plurality of flexible arcuate fingers formed integrally therewith in longitudinal spaced relation, each of the fingers located adjacent the opposite edge of said baffle and extending through an associated vent, each finger having an arcuate surface for engaging the adjacent edge portion of its associated vent, each of the fingers spaced intermediate adjacent pairs of the cover concave-like bearing surfaces, baffle retaining means on said cover at each finger location causing elastic longitudinal arching of the flexible baffle between its bearing portions, which arching acts to frictionally hold each finger arcuate surface in a given relative position with its respective vent edge, each of the fingers including stop means for engagement with a stop surface carried by said plate cover, whereby said vent means structure constructed and arranged such that said baffle may be rotated by the user from a fully closed to a fully open setting while imparting positioned stability so that the user may retain said baffle at any desired intermediate setting between its open and closed positions.

4. In combination with a refrigerator cabinet having a food storage chamber furnished with a front access opening normally closed by a door, a refrigerating system associated with said cabinet including a refrigerant evaporator for chilling the interior thereof; a food storage assembly including side-by-side drawers and a supporting cover plate member therefor, said cover plate including integral flange means depending from each side thereof and an intermediate location providing two pairs of confronting longitudinal extending drawer trackways, means on each drawer in slidable engagement with its associated trackways, wherein the improvement for the food storage assembly comprising moisture control vent means therefor, said vent means including a series of generally rectangular shaped air vents provided in each said side flange means, a pair of one piece identical baffles for adjusting the quantity of circulated air between the fresh food compartment and each drawer, each side flange having baffle engagement portions in the form of a plurality of spaced concave-like bearing surfaces opening upwardly therefrom, one edge of each baffle formed with a convex hinge surface adapted to pivot within the cover bearing surfaces, said baffle including a plurality of flexible arcuate fingers formed integrally therewith in longitudinal spaced relation, each of the fingers located adjacent the opposite edge of each baffle and extending through an associated vent, each finger having an arcuate surface for engaging the adjacent edge portion of its associated vent, each of the fingers spaced intermediate adjacent pairs of the cover concave-like bearing surfaces, baffle retaining means on each side flange at each finger location causing elastic longitudinal arching of the flexible baffle between its bearing portions, which arching acts to frictionally hold each finger arcuate surface in a given relative position with its respective vent edge, each of the fingers including stop means for engagement with a stop surface carried by said plate cover, a manual gripping tab portion adjacent each end of said baffle formed at an inwardly canted angle from the plane of the baffle, whereby said vent means structure constructed and arranged such that said baffle may be gripped by a front end tab and rotated by the user from a fully closed to a fully open setting while imparting positioned stability so that the user may retain said baffle at any desired intermediate setting between its open and closed positions, and front and rear recessed portions formed in said cover plate adjacent each side flange for receiving associated ones of the gripping tab portions, such that either one of the baffles may be reversed end-for-end and used interchangeably with either series of air vents.

* * * * *